US011225782B2

(12) United States Patent
Yan et al.

(10) Patent No.: US 11,225,782 B2
(45) Date of Patent: Jan. 18, 2022

(54) BUTTON STRUCTURE OF PULL-OUT SPRAY HEAD

(71) Applicant: Xiamen Forbetter Sanitary Ware Co., Ltd., Fujian (CN)

(72) Inventors: Xiliang Yan, Xiamen (CN); Yihui Chen, Xiamen (CN)

(73) Assignee: XIAMEN FORBETTER SANITARY WARE CO., LTD., Fujian (CN)

( * ) Notice: Subject to any disclaimer, the term of this patent is extended or adjusted under 35 U.S.C. 154(b) by 264 days.

(21) Appl. No.: 16/556,137

(22) Filed: Aug. 29, 2019

(65) Prior Publication Data

US 2021/0062483 A1 Mar. 4, 2021

(51) Int. Cl.
*B05B 1/18* (2006.01)
*E03C 1/04* (2006.01)

(52) U.S. Cl.
CPC ..... *E03C 1/0409* (2013.01); *E03C 1/0404* (2013.01); *B05B 1/18* (2013.01); *E03C 2001/0415* (2013.01)

(58) Field of Classification Search
CPC ..... E03C 1/0409; E03C 1/0404; E03C 2001/0415; B05B 1/169; B05B 1/18; B05B 1/1618
See application file for complete search history.

(56) References Cited

U.S. PATENT DOCUMENTS 6,274,826 B1 * 8/2001 Serizawa ..... H01H 23/003 200/1 B
2007/0221757 A1 * 9/2007 Malek ..... E03C 1/0405 239/447
2017/0182503 A1 * 6/2017 Moehring ..... B05B 1/169

* cited by examiner

*Primary Examiner* — Qingzhang Zhou
(74) *Attorney, Agent, or Firm* — Leong C. Lei

(57) ABSTRACT

A button structure of a pull-out spray head includes a main body, an operating assembly, and two switching assemblies. The two switching assembles are disposed on the main body and configured to switch spray modes of the pull-out spray head. The two switching assembles are linked with the operating assembly. A return structure is provided for the operating assembly to drive the switching assemblies to counter the water pressure and to be returned in place, so that the spray modes of the pull-out spray head can be switched in place to ensure water discharge of the pull-out spray head so as to improve the user experience.

8 Claims, 6 Drawing Sheets

BUTTON STRUCTURE OF PULL-OUT SPRAY HEAD

BACKGROUND OF THE INVENTION

1. Field of the Invention

The present invention relates to sanitary wares, and more particularly, to a button structure of a pull-out spray head.

2. Description of the Prior Art

Pull-out spray heads are new popular sanitary wares in recent years. They are generally installed on wash basins for the user to wash his/her hair or face or cleaning the bathroom. The spray head has different spray modes for different purposes so as to achieve a better cleaning effect. The existing pull-out spray heads have few functions. In general, the spray head is provided with a switching button for switching two different spray modes, which is difficult to meet the increasing demands of users. For increasing the functions of the pull-out spray head, it is necessary to increase the number of buttons and waterways. The pull-out spray head becomes larger and heavier, which not only increases the production cost but also is inconvenient for use.

For this reason, a single-button multi-function pull-out spray head is developed on the market. The typical one is a single-button three-function pull-out spray head which can realize three spray modes through a single button. This pull-out spray head can meet the user's demand for multiple functions, and is compact and small in size, and is convenient for the user to operate. The main structure comprises a main body, a switching button, and two switching assemblies. The main body has a water inlet passage, two water-passing chambers, and three water outlet passages. One of the water-passing chambers is formed with a first water inlet, a first water outlet, and a second water outlet. The other water-passing chamber is formed with a second water inlet, a third water outlet, and a fourth water outlet. The first water inlet is in communication with the water inlet passage. The first water outlet is in communication with the second water inlet. The second water outlet is in communication with the first water outlet passage. The third water outlet is in communication with the second water outlet passage. The fourth water outlet is in communication with the third water outlet passage. The two switching assemblies respectively control opening and closing of the two water outlets of the two water-passing chambers. The two switching assemblies are returned through return springs, and the two are linked by the switching button, so that the single switching button controls three different water outlet passages to discharge water, that is, three spray modes are switched. One of the spray modes (i.e., the default state) is that the switching button and the switching assemblies are in an equilibrium state through the return springs to realize water discharge. The other two spray modes are by pressing either end of the switching button to counter the elastic force of the corresponding return spring for switching the corresponding water outlet to discharge water.

However, in use, when the three spray modes of the pull-out spray head are switched, because there is water flow inside the main body to cause water pressure, the water pressure will counter the elastic force of the return spring to affect the returning of the switching assembly. As a result, it is difficult to implement full switching between the spray modes (only the corresponding water outlet passage of each spray mode is to discharge water), especially it is difficult to switch from the second and third spray modes to the first spray mode (because it is necessary to ensure that both return springs are returned to the equilibrium state). This situation is particularly noticeable when the two return springs are not aged to the same extent.

SUMMARY OF THE INVENTION

The primary object of the present invention is to provide a button structure of a pull-out spray head, which can switch the spray modes of the pull-out spray head in place to ensure water discharge of the spray pull-out head so as to improve the user experience.

In order to achieve the above object, the present invention adopts the following technical solutions:

A button structure of a pull-out spray head comprises a main body, a first switching assembly, a second switching assembly, and an operating assembly. The first switching assembly and the second switching assembly are disposed on the main body and configured to switch spray modes of the pull-out spray head. The main body is formed with a pivot portion located between the first switching assembly and the second switching assembly. The operating assembly includes a switching button and two actuating members. The switching button is mounted on the pivot portion and formed with an actuating chamber having an opening facing the pivot portion. The two actuating members are respectively pivotally connected to two sides of the pivot portion and located in the actuating chamber. One actuating member is linked with the first switching assembly, and the other actuating member is linked with the second switching assembly. A limiting structure is disposed between two ends of the opening of the actuating chamber and actuating ends of the actuating members for restricting the actuating ends of the actuating members from coming out of the actuating chamber. The switching button is selectively pivotable and movable relative to the main body through the pivot portion. A return structure is disposed between the actuating chamber and the pivot portion for returning the switching button in a direction away from the main body.

Preferably, the return structure includes two elastic pieces disposed at a bottom of the actuating chamber. Two sides of a top of the pivot portion are formed with guiding surfaces corresponding to the elastic pieces. Ends of the two elastic pieces are movably fitted on the two guiding surfaces, respectively. The pivot portion is located between the two elastic pieces to splay the two elastic pieces outwardly when the switching button is moved toward the main body.

Preferably, the return structure further includes an elastic member disposed between the two elastic pieces, and two ends of the elastic member are fitted to the bottom of the actuating chamber and the top of the pivot portion, respectively.

Preferably, the elastic member is a spring.

Preferably, the bottom of the actuating chamber is formed with a spring retaining post. One end of the spring is sleeved on the spring retaining post, and another end of the spring abuts against the top of the pivot portion.

Preferably, the limiting structure includes limiting protrusions disposed at the two ends of the opening of the actuating chamber and limiting grooves disposed at the actuating ends of the actuating members. The limiting protrusions are movably fitted in the limiting grooves along with rotation of the actuating members in the actuating chamber for restricting the actuating ends of the actuating members from coining out of the actuating chamber.

Preferably, the pivot portion includes a pivot shaft. Two sides of a middle portion of the switching button are formed with pivot holes. Two ends of the pivot shaft are movably fitted in the pivot holes. Each of the pivot holes is formed with a receiving space for the pivot shaft to move when the switching button is moved relative to the main body. The actuating members are pivotally connected to the two ends of the pivot shaft, respectively.

Preferably, each of the pivot holes has an opening facing the main body. Two sides of the opening of each of pivot holes are reduced inwardly to form limiting portions for restricting the pivot shaft from coming out of the pivot holes. The receiving space is disposed in a middle portion of each of the pivot holes.

Preferably, the first switching assembly includes a first switching rod. An end of the first switching rod of the first switching assembly is formed with a first spherical head. The second switching assembly includes a second switching rod. An end of the second switching rod of the second switching assembly is formed with a second spherical head. An inner side of the actuating end of each of the actuating members is formed with an engaging groove through which the first switching rod or the second switching rod is inserted. The first spherical head and the second spherical head are respectively movably fitted to one side of the engaging groove of a corresponding one of the actuating members facing the actuating chamber.

With the above structure, the present invention realizes the linkage of the first switching assembly and the second switching assembly through the operating assembly. The limiting structure is provided to prevent the actuating members from disengaging from the actuating chamber, so that the actuating members can drive the first switching assembly and the second switching assembly to counter the water pressure and to be returned in place. The return structure is provided to provide the power for returning. The spray modes of the pull-out spray head can be switched in place to ensure water discharge of the pull-out spray head so as to improve the user experience.

DETAILED DESCRIPTION OF THE PREFERRED EMBODIMENTS

Figure 1:
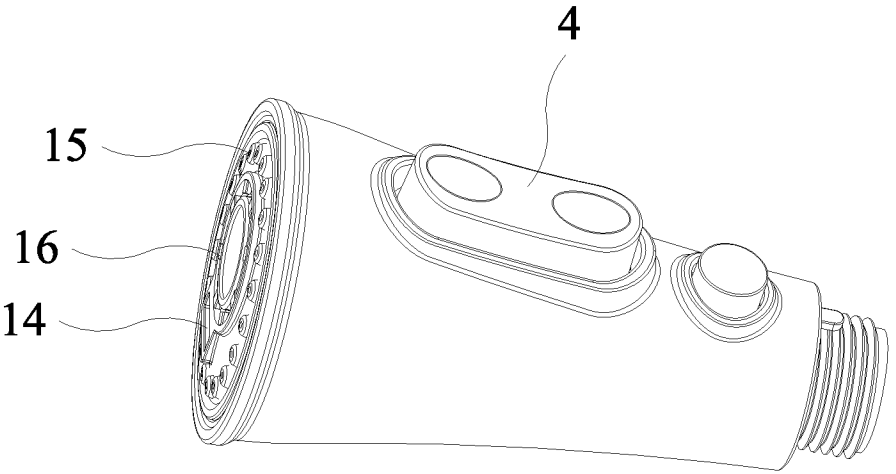
FIG. 1 is a perspective view in accordance with a preferred embodiment of the present invention.
Figure 2:
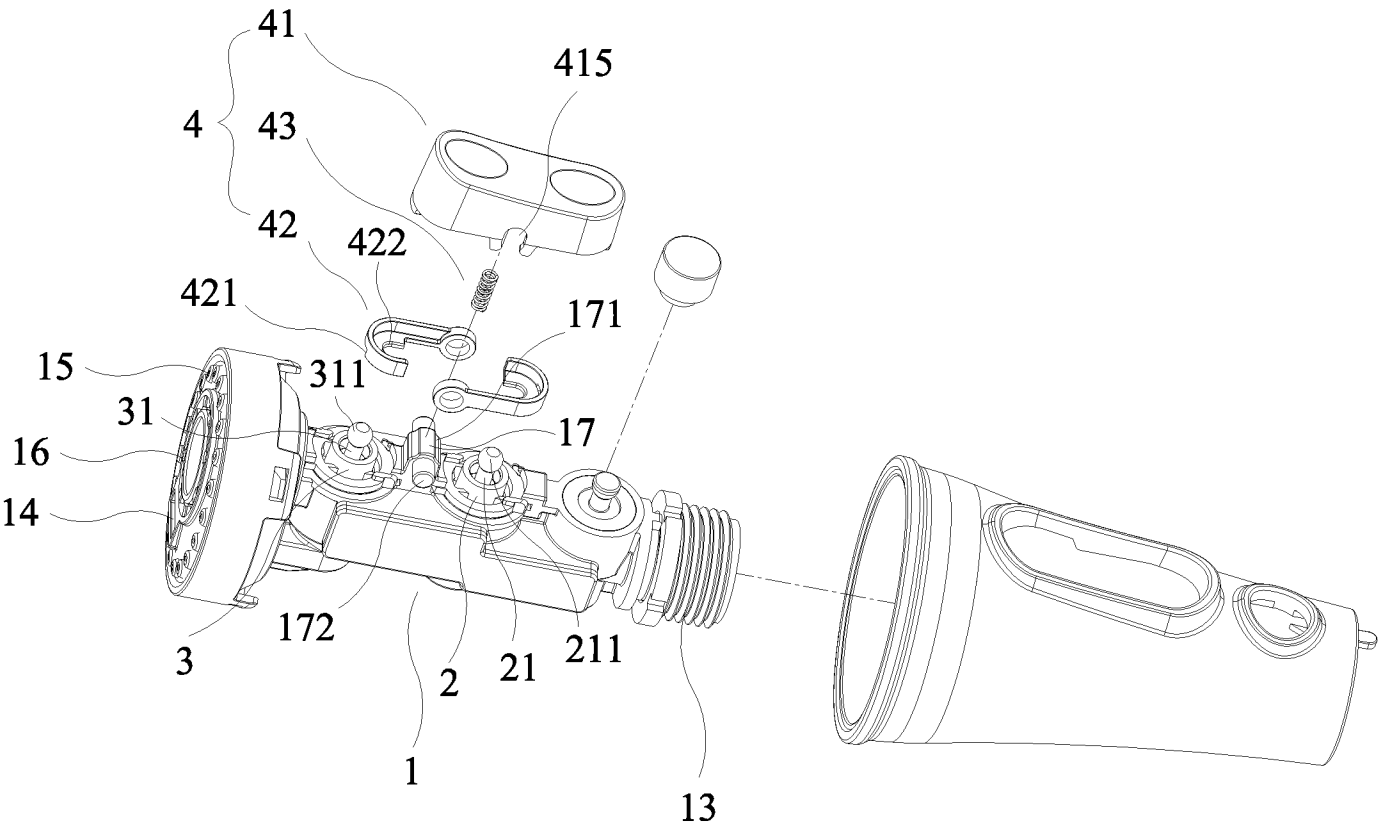
FIG. 2 is an exploded view in accordance with the preferred embodiment of the present invention.

In order to further explain the technical solution of the present invention, embodiments of the present invention will now be described, by way of example only, with reference to the accompanying drawings.

As shown in FIG. 1 through FIG. 5, the present invention discloses a button structure of a pull-out spray head, which is mainly applied to a pull-out spray head for switching three different spray modes of the pull-out spray head, comprising a main body 1, a first switching assembly 2, a second switching assembly 3, and an operating assembly 4.

The main body 1 is formed with a first water-passing chamber 11, a second water-passing chamber 12, a water inlet passage 13, a first water outlet passage 14, a second water outlet passage 15, and a third water outlet passage 16. The first water-passing chamber 11 is formed with a first water inlet 111, a first water outlet 112, and a second water outlet 113. The second water-passing chamber 12 is formed with a second water inlet 121, a third water outlet 122, and a fourth water outlet 123. The first water inlet 111 is in communication with the water inlet passage 13. The first water outlet 112 is in communication with the second water inlet 121. The second water outlet 113 is in communication with the first water outlet passage 14. The third water outlet 122 is in communication with the second water outlet passage 15. The fourth water outlet 123 is in communication with the third outlet passage 16. The first switching assembly 2 is disposed corresponding to the first water-passing chamber 11 to control opening and closing of the first water outlet 112 and the second water outlet 113. The second switching assembly 3 is disposed corresponding to the second water-passing chamber 12 to control opening and closing of the third water outlet 122 and the fourth water outlet 123.

The main body 1 is formed with a pivot portion 17 located between the first switching assembly 2 and the second switching assembly 3. The operating assembly 4 includes a switching button 41 and two actuating members 42. The switching button 41 is mounted on the pivot portion 17 and formed with an actuating chamber 411 having an opening facing the pivot portion 17. The two actuating members 42 are respectively pivotally connected to two sides of the pivot portion 17 and located in the actuating chamber 411. One actuating member 42 is linked with the first switching assembly 2, and the other actuating member 42 is linked with the second switching assembly 3. A limiting structure is disposed between two ends of the opening of the actuating chamber 411 and actuating ends of the actuating members 42 for restricting the actuating ends of the actuating members 42 from coming out of the actuating chamber 411. The switching button 41 is selectively pivotable and movable relative to the main body 1 through the pivot portion 17. A return structure is disposed between the actuating chamber 411 and the pivot portion 17 for returning the switching button 41 in a direction away from the main body 1.

The return structure includes two elastic pieces 412 disposed at the bottom of the actuating chamber 411. Two sides of the top of the pivot portion 17 are formed with guiding surfaces 171 corresponding to the elastic pieces 412. The ends of the two elastic pieces 412 are movably fitted on the two guiding surfaces 171, respectively. When the switching button 41 is moved toward the main body 1, the pivot portion 17 will be located between the two elastic pieces 412 to splay the two elastic pieces 412 outwardly. When a force is applied to the middle of the switching button 41 for the switching button 41 to be moved toward the main body 1, the elastic pieces 412 slide on the guiding surfaces 171 and move away from each other to form a space for receiving the pivot portion 17 therein. After the switching button 41 is released, the two elastic pieces 412 are restored to their original shapes and the pivot portion 17 is pushed out of the space between the two elastic pieces 412 to complete the returning.

The return structure further includes an elastic member disposed between the two elastic pieces 412. Two ends of the elastic member are fitted to the bottom of the actuating chamber 411 and the top of the pivot portion 17, respectively. In this embodiment, the elastic member is a spring 43. The bottom of the actuating chamber 411 is formed with a spring retaining post 413. One end of the spring 43 is sleeved on the spring retaining post 413, and another end of the spring 43 abuts against the top of the pivot portion 17. In this embodiment, the limiting structure includes limiting protrusions 414 disposed at the two ends of the opening of the actuating chamber 411 and limiting grooves 421 disposed at the actuating ends of the actuating members 42. The limiting protrusions 414 are movably fitted in the limiting grooves 421 along with rotation of the actuating members 42 in the actuating chamber 411 for restricting the actuating ends of the actuating members 42 from coming out of the actuating chamber 411. The limiting structure is not limited to the above implementation that is taken as an example only. Any structure that can restrict the actuating members 42 from coming out of the actuating chamber 411 without affecting the rotation of the actuating members 42 and that can meet the design requirements of the limiting structure of the present invention is applicable.

Figure 3:
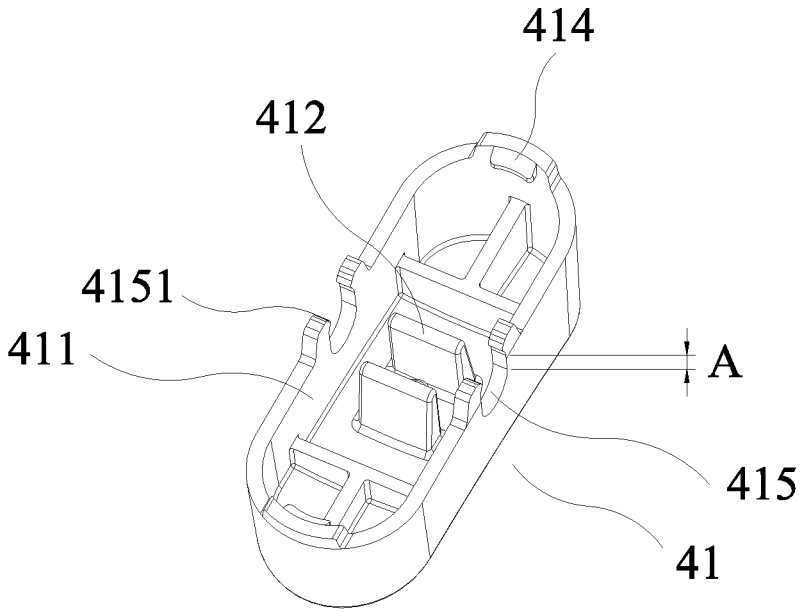
FIG. 3 is a perspective view of the switching button of the present invention.

The pivot portion 17 includes a pivot shaft 172. Two sides of a middle portion of the switching button 41 are formed with pivot holes 415. Two ends of the pivot shaft 172 are movably fitted in the pivot holes 415. The pivot hole 415 is formed with a receiving space A for the pivot shaft 172 to move when the switching button 41 is moved relative to the main body 1. The actuating members 42 are pivotally connected to the two ends of the pivot shaft 172, respectively. As shown in FIG. 3, in this embodiment, each pivot hole 415 has an opening facing the main body 1. Two sides of the opening of each pivot hole 415 are reduced inwardly to form limiting portions 4151 for restricting the pivot shaft 172 from coming out of the pivot holes 415. The receiving space A is disposed in a middle portion of each pivot hole 415.

The first switching assembly 2 includes a first switching rod 21. The end of the first switching rod 21 of the first switching assembly 2 is formed with a first spherical head 211. The second switching assembly 3 includes a second switching rod 31. The end of the second switching rod 31 of the second switching assembly 3 is formed with a second spherical head 311. The inner side of the actuating end of each actuating member 42 is formed with an engaging groove 422 through which the first switching rod 21 or the second switching rod 31 is inserted. The first spherical head 211 and the second spherical head 311 are respectively movably fitted to one side of the engaging groove 422 of the corresponding actuating member 42 facing the actuating chamber 411, so that the actuating member 42 is linked with the first switching assembly 2 or the second switching assembly 3.

Figure 5:
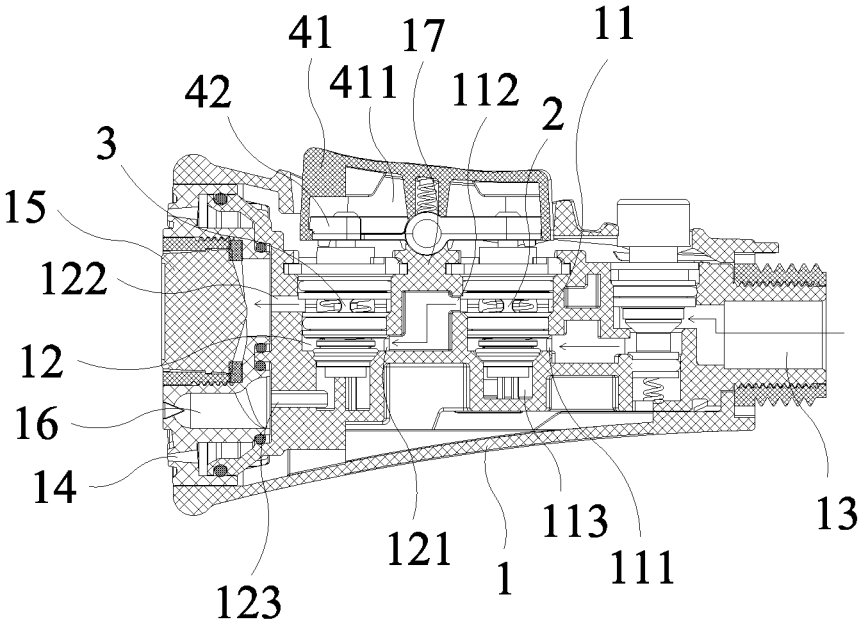
FIG. 5 is a schematic view showing the water flow in the first spray mode (default state) of the present invention.

FIG. 5 illustrates a first spray mode (default state) of the present invention. The switching button 41 is not applied with a force, and the operating assembly 4, the first switching assembly 2 and the second switching assembly 3 are in an equilibrium state. At this time, the first switching assembly 2 controls the first water outlet 112 to be opened and the second water outlet 113 to be closed; and the second switching assembly 3 controls the third water outlet 122 to be opened and the fourth water outlet 123 to be closed, thereby allowing the second water outlet passage 15 to discharge water, that is, the main body 1 in a first spray mode.

Figure 4:
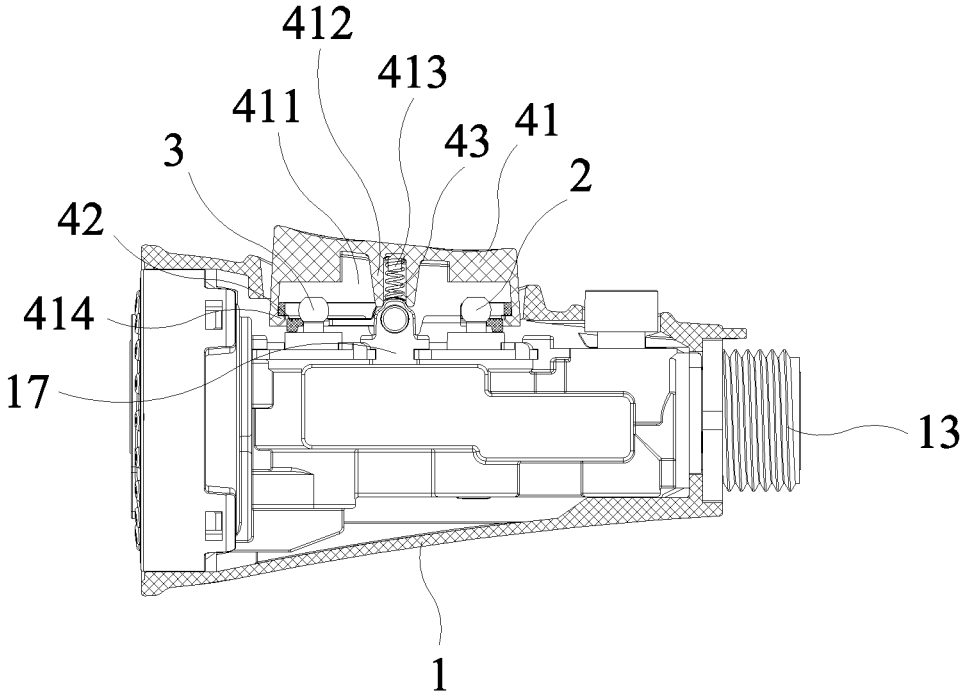
FIG. 4 is a cross-sectional view in accordance with the preferred embodiment of the present invention.
Figure 6:
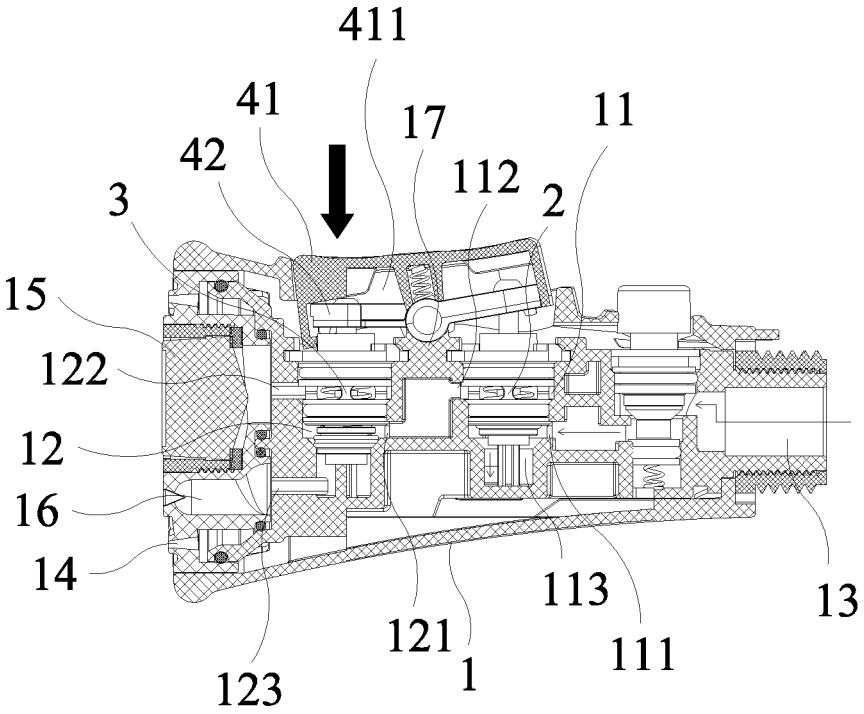
FIG. 6 is a schematic view showing the water inflow of the present invention switched to the second spray mode.
Figure 7:
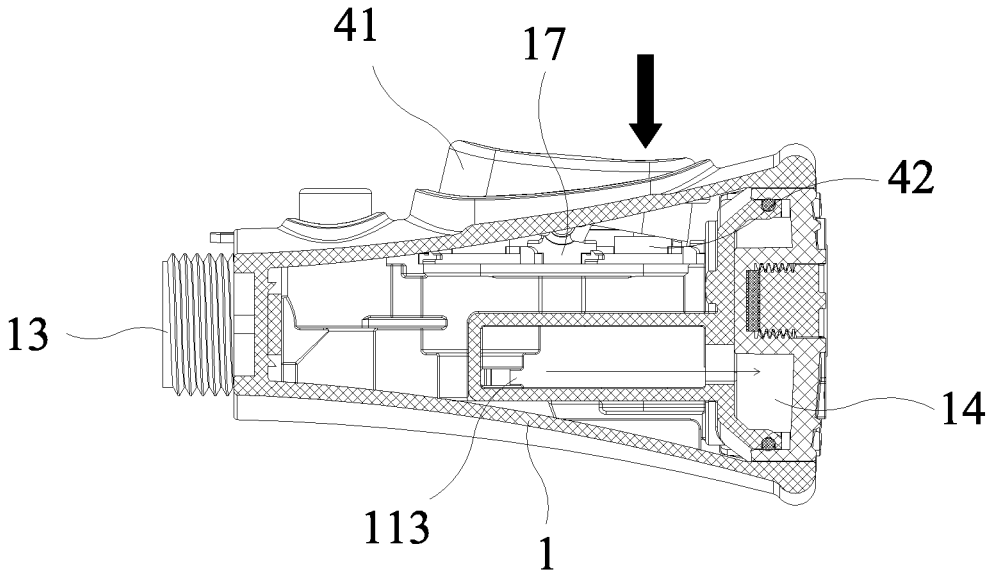
FIG. 7 is a schematic view showing the water outflow of the present invention switched to the second spray mode.

Referring to FIGS. 4, 6, and 7, when a force is applied to the left end of the switching button 41 (as indicated by the arrow in FIG. 6), the left end of the switching button 41 is rotated downward, and the switching button 41 drives the right actuating member 42 to rotate relative to the main body 1 through the limiting structure to pull the first switching assembly 2 upward. At this time, the first switching assembly 2 controls the first water outlet 112 to be closed and the second water outlet 113 to be opened; and the second switching assembly 3 controls the third water outlet 122 to be opened and the fourth water outlet 123 to be closed, thereby allowing the first water outlet passage 14 to discharge water, that is, the main body 1 in a second spray mode.

Figure 8:
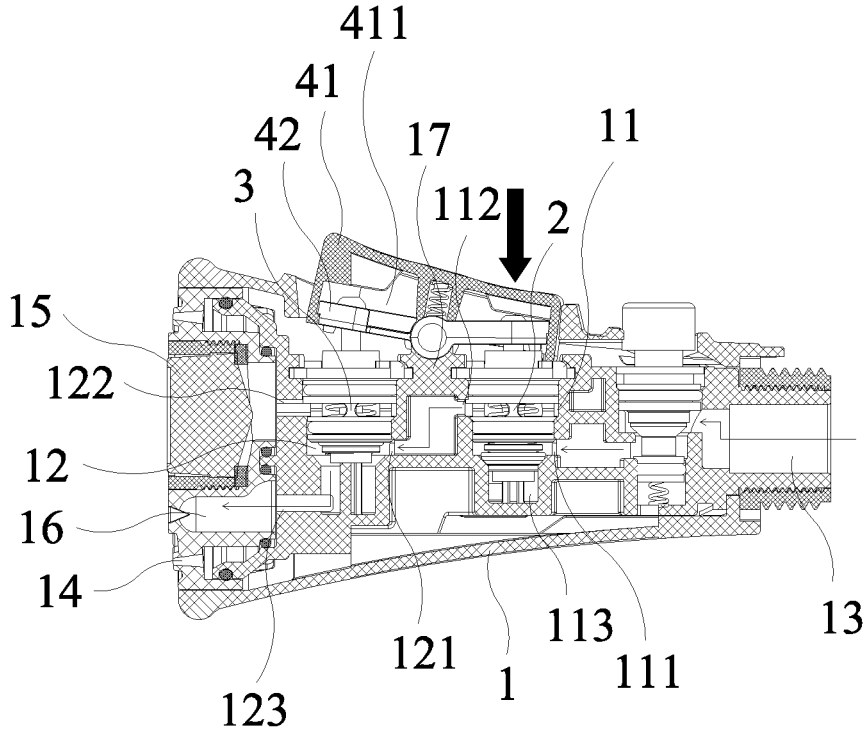
FIG. 8 is a schematic view showing the water flow in the third spray mode of the present invention.

Referring to FIG. 4 and FIG. 8, when a force is applied to the right end of the switching button 41 (as indicated by the arrow in FIG. 8), the right end of the switching button 41 is rotated downward, and the switching button 41 drives the left actuating member 42 to rotate relative to the main body 1 through the limiting structure to pull the second switching assembly 3 upward. At this time, the first switching assembly 2 controls the first water outlet 112 to be opened and the second water outlet 113 to be closed; and the second switching assembly 3 controls the third water outlet 122 to be closed and the fourth water outlet 123 to be opened, thereby allowing the third water outlet passage 16 to discharge water, that is, the main body 1 in a second spray mode.

Figure 9:
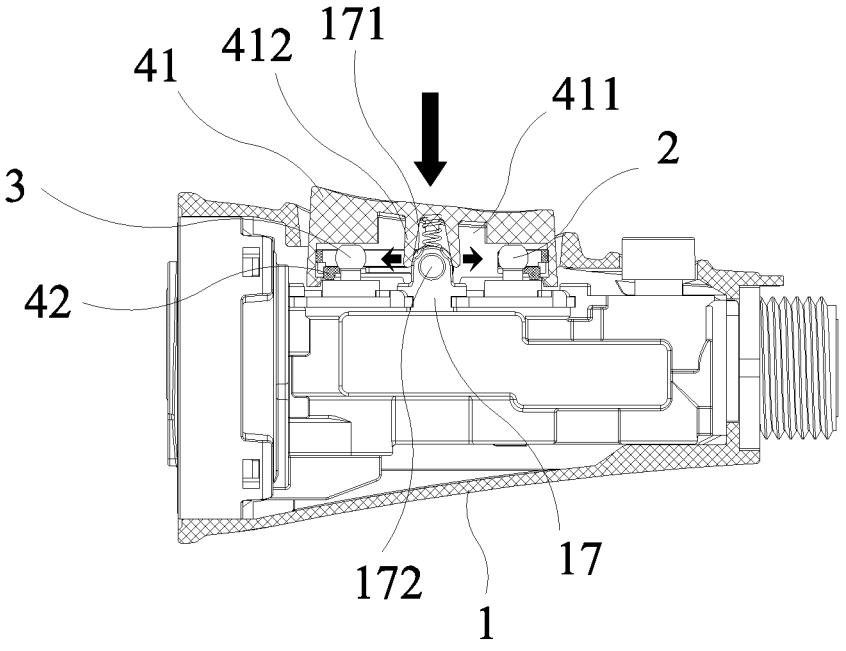
FIG. 9 is a schematic view of the working principle in accordance with the preferred embodiment of the present invention.

Referring to FIG. 9, when a force is applied to the middle of the switching button 41 (as indicated by the arrow in FIG. 8), the switching button 41 is moved toward the main body 1, and the pivot portion 17 is located between the two elastic pieces 412 to splay the two elastic pieces 412 outwardly. After the switching button 41 is released, the two elastic pieces 412 are restored to their original shapes and the pivot portion 17 is pushed out of the two elastic pieces 412 to complete the returning, that is, the switching button 41 is returned in a direction away from the main body 1. At the same time, the switching button 41 drives the two actuating members 42 to be returned through the limiting structure, that is, the actuating members 42 pull up the first switching assembly 2 and the second switching assembly 3 to be returned. At this time, the first switching assembly 2 controls the first water outlet 112 to be opened and the second water outlet 113 to be closed; and the second switching assembly 3 controls the third water outlet 122 to be opened and the fourth water outlet 123 to be closed, that is, the main body 1 is restored to the first spray mode.

With the above structure, the present invention realizes the linkage of the first switching assembly 2 and the second switching assembly 3 through the operating assembly 4. The limiting structure is provided to prevent the actuating members 42 from disengaging from the actuating chamber 411, so that the actuating members 42 can drive the first switching assembly 2 and the second switching assembly 3 to counter the water pressure and to be returned in place. The return structure is provided to provide the power of returning. The spray modes of the pull-out spray head can be switched in place to ensure water discharge of the pull-out spray head so as to improve the user experience.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A button structure of a pull-out spray head, comprising a main body, a first switching assembly, a second switching assembly, and an operating assembly; the first switching assembly and the second switching assembly being disposed on the main body and configured to switch spray modes of the pull-out spray head; the main body being formed with a pivot portion located between the first switching assembly and the second switching assembly;

the operating assembly including a switching button and two actuating members;

the switching button being mounted on the pivot portion and formed with an actuating chamber having an opening facing the pivot portion; the two actuating members being respectively pivotally connected to two sides of the pivot portion and located in the actuating chamber, one actuating member being linked with the first switching assembly, the other actuating member being linked with the second switching assembly; limiting protrusions being disposed between two ends of the opening of the actuating chamber and actuating ends of the actuating members for restricting the actuating ends of the actuating members from coining out of the actuating chamber; the switching button being selectively pivotable and movable relative to the main body through the pivot portion; a return structure being disposed between the actuating chamber and the pivot portion for returning the switching button in a direction away from the main body; wherein the return structure includes two elastic pieces disposed at a bottom of the actuating chamber, two sides of a top of the pivot portion are formed with guiding surfaces corresponding to the elastic pieces, ends of the two elastic pieces are movably fitted on the two guiding surfaces respectively, and the pivot portion is located between the two elastic pieces to splay the two elastic pieces outwardly when the switching button is moved toward the main body.

2. The button structure of the pull-out spray head as claimed in claim 1, wherein the return structure further includes an elastic member disposed between the two elastic pieces, and two ends of the elastic member are fitted to the bottom of the actuating chamber and the top of the pivot portion, respectively.

3. The button structure of the pull-out spray head as claimed in claim 2, wherein the elastic member is a spring.

4. The button structure of the pull-out spray head as claimed in claim 3, wherein the bottom of the actuating chamber is formed with a spring retaining post, one end of the spring is sleeved on the spring retaining post, and another end of the spring abuts against the top of the pivot portion.

5. The button structure of the pull-out spray head as claimed in claim 1, wherein limiting grooves are disposed at the actuating ends of the actuating members, and the limiting protrusions are movably fitted in the limiting grooves along with rotation of the actuating members in the actuating chamber for restricting the actuating ends of the actuating members from coining out of the actuating chamber.

6. The button structure of the pull-out spray head as claimed in claim 1, wherein the pivot portion includes a pivot shaft, two sides of a middle portion of the switching button are formed with pivot holes, two ends of the pivot shaft are movably fitted in the pivot holes, each of the pivot holes is formed with a receiving space for the pivot shaft to move when the switching button is moved relative to the main body; and the actuating members are pivotally connected to the two ends of the pivot shaft, respectively.

7. The button structure of the pull-out spray head as claimed in claim 6, wherein each of the pivot holes has an opening facing the main body, two sides of the opening of each of pivot holes are reduced inwardly to form limiting portions for restricting the pivot shaft from coining out of the pivot holes; and the receiving space is disposed in a middle portion of each of the pivot holes.

8. The button structure of the pull-out spray head as claimed in claim 1, wherein the first switching assembly includes a first switching rod, an end of the first switching rod of the first switching assembly is formed with a first spherical head, the second switching assembly includes a second switching rod, an end of the second switching rod of the second switching assembly is formed with a second spherical head, an inner side of the actuating end of each of the actuating members is formed with an engaging groove through which the first switching rod or the second switching rod is inserted, the first spherical head and the second spherical head are respectively movably fitted to one side of the engaging groove of a corresponding one of the actuating members facing the actuating chamber.

* * * * *